US009604454B2

(12) United States Patent
Yamamuro et al.

(10) Patent No.: US 9,604,454 B2
(45) Date of Patent: Mar. 28, 2017

(54) METHOD FOR MANUFACTURING LIQUID EJECTION HEAD

(71) Applicant: CANON KABUSHIKI KAISHA, Tokyo (JP)

(72) Inventors: Jun Yamamuro, Yokohama (JP); Satoshi Ibe, Yokohama (JP); Toshiaki Kurosu, Oita (JP); Shiro Sujaku, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 14/679,904

(22) Filed: Apr. 6, 2015

(65) Prior Publication Data

US 2015/0290939 A1 Oct. 15, 2015

(30) Foreign Application Priority Data

Apr. 9, 2014 (JP) ..... 2014-080390

(51) Int. Cl.
*B21D 53/00* (2006.01)
*B41J 2/14* (2006.01)
*B41J 2/16* (2006.01)

(52) U.S. Cl.
CPC ..... *B41J 2/1404* (2013.01); *B41J 2/1433* (2013.01); *B41J 2/162* (2013.01); *B41J 2/1603* (2013.01); *B41J 2/1628* (2013.01); *B41J 2/1631* (2013.01); *B41J 2/1639* (2013.01); *B41J 2/1645* (2013.01); *B41J 2/1646* (2013.01); *B41J 2002/14475* (2013.01)

(58) Field of Classification Search
CPC ..... B41J 2/1404; B41J 2/1433; B41J 2/1603; B41J 2/162; B41J 2002/14475; B41J 2/1631; B41J 2/1639; B41J 2/1645; B41J 2/1646; B41J 2/1628
USPC ..... 29/890.1
See application file for complete search history.

(56) References Cited

U.S. PATENT DOCUMENTS 4,479,134 A * 10/1984 Kawanabe ..... B41J 2/04541 347/2
6,527,376 B1 * 3/2003 Itaya ..... B41J 2/1404 347/56
7,942,489 B2 * 5/2011 Ushinohama ..... B41J 2/04505 347/10

(Continued)

FOREIGN PATENT DOCUMENTS

JP 6-286149 A 10/1994

*Primary Examiner* — Paul D Kim
(74) *Attorney, Agent, or Firm* — Canon U.S.A. Inc., IP Division

(57) ABSTRACT

A method for manufacturing a liquid ejection head having a substrate, heat generating elements formed at the front surface side of the substrate, and a nozzle layer forming liquid chambers and liquid ejection ports at the front surface side of the substrate, and the method includes a process of preparing a substrate having heat generating elements and a nozzle layer formation material layer at the front surface side, a process of driving the heat generating elements for heating to form air bubbles serving as the liquid chambers in the nozzle layer formation material layer, and a process of forming liquid ejection ports which communicate with the liquid chambers in the nozzle layer formation material layer, and then forming a nozzle layer forming the liquid chambers and the liquid ejection ports at the front surface side of the substrate.

10 Claims, 5 Drawing Sheets

(56) References Cited

U.S. PATENT DOCUMENTS

2007/0052759 A1* 3/2007 Park ..... B41J 2/1404
347/61

* cited by examiner

METHOD FOR MANUFACTURING LIQUID EJECTION HEAD

BACKGROUND OF THE INVENTION

Field of the Invention

The present invention relates to a method for manufacturing a liquid ejection head.

Description of the Related Art

A liquid ejection head is used in a liquid ejecting apparatus, such as an ink jet recording apparatus, and ejects liquid (ink) onto a recording medium, such as paper, utilizing energy-generating elements, and then records an image and the like. The liquid ejection head has a substrate on which energy-generating elements, such as a heat generating element and a piezoelectric body, are formed, and a nozzle layer formed on the substrate. In the substrate, a liquid supply port is formed. In the nozzle layer, liquid chambers and a liquid flow passage are formed. Moreover, liquid ejection ports are formed in an upper portion of the nozzle layer. Liquid supplied to the liquid chambers from the liquid supply port of the substrate receives energy from the energy-generating elements, and then is ejected from the liquid ejection ports.

Methods for manufacturing a liquid ejection head include a method described in Japanese Unexamined Patent Application Publication No. 6-286149. According to the method described in Japanese Unexamined Patent Application Publication No. 6-286149, a substrate having energy-generating elements at the front surface side is first prepared. Next, a positive photosensitive resin is applied to the front surface side of the substrate, and then the applied positive photosensitive resin is patterned by photolithography to thereby form a mold material of liquid chambers from the positive photosensitive resin. Next, the formed mold material is covered with a negative photosensitive resin, and then the negative photosensitive resin is patterned by photolithography to thereby form a nozzle layer having liquid ejection ports from the negative photosensitive resin. Next, the front surface side of the substrate and the nozzle layer are covered with a protective layer and the like, and then etching is performed from the back surface side of the substrate to form a liquid supply port in the substrate. Then, the protective layer is removed and further the mold material is removed, whereby liquid chambers are formed in the nozzle layer. The liquid ejection head is manufactured as described above.

The method for manufacturing a liquid ejection head described in Japanese Unexamined Patent Application Publication No. 6-286149 described above is a method excellent in practicality. However, the formation positions of the energy-generating elements on the substrate sometimes slightly vary due to a manufacturing error and the like. In addition thereto, since the liquid chambers are formed by patterning of the positive photosensitive resin, an advanced technique is required for registration of the energy-generating elements and the liquid chambers. When the positional relationship of the heat generating elements and the liquid chambers varies, the liquid ejection properties of the liquid ejection head may be affected.

Therefore, it is an object of the present invention to provide a method for manufacturing a liquid ejection head capable of easily matching the formation positions of energy-generating elements with the formation positions of liquid chambers in the liquid ejection head.

SUMMARY OF THE INVENTION

The above-described problems are solved by the present invention described below. More specifically, the present invention is a method for manufacturing a liquid ejection head having a substrate, heat generating elements formed at the front surface side of the substrate, and a nozzle layer forming liquid chambers and liquid ejection ports at the front surface side of the substrate, and the method includes a process of preparing a substrate having heat generating elements and a nozzle layer formation material layer at the front surface side, a process of driving the heat generating elements for heating to form air bubbles serving as liquid chambers in the nozzle layer formation material layer, and a process of forming liquid ejection ports which communicate with the liquid chambers in the nozzle layer formation material layer, and then forming a nozzle layer forming the liquid chambers and the liquid ejection ports at the front surface side of the substrate.

Further features of the present invention will become apparent from the following description of exemplary embodiments with reference to the attached drawings.

DESCRIPTION OF THE EMBODIMENTS

Figure 1:
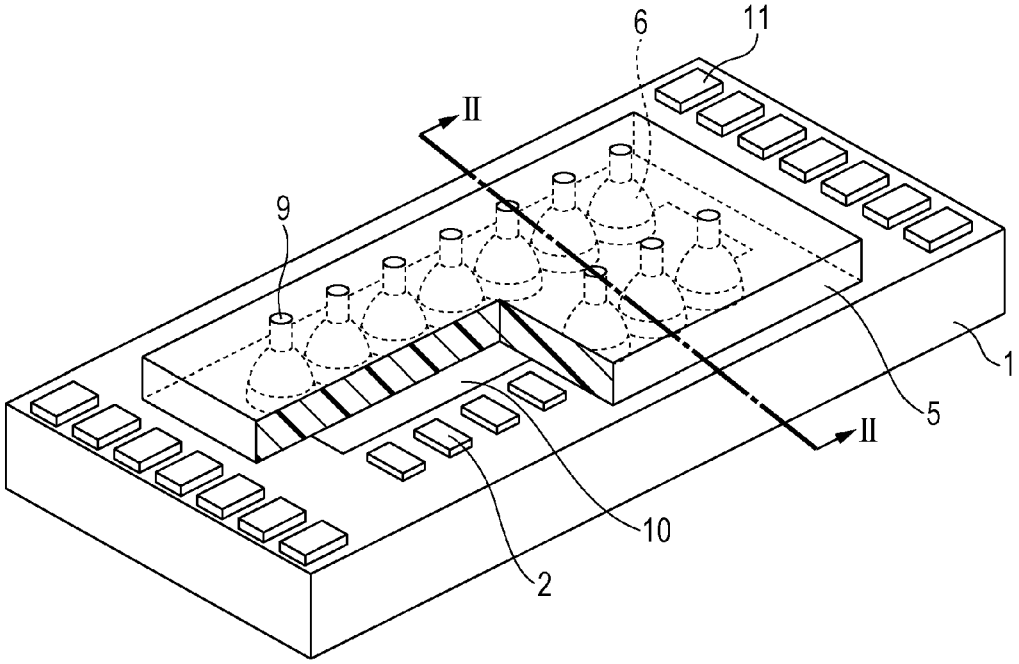
FIG. 1 is a view illustrating an example of a liquid ejection head manufactured by the present invention.

FIG. 1 illustrates an example of a liquid ejection head manufactured by a method for manufacturing a liquid ejection head of the present invention. The liquid ejection head has a substrate 1 in which a liquid supply port 10 is formed and a nozzle layer 5 formed on the substrate 1. With respect to the substrate 1, the side on which the nozzle layer is formed is a front surface side and the opposite side is a back surface side. More specifically, the nozzle layer is formed at the front surface side of the substrate. Moreover, heat generating elements 2, which are energy-generating elements, are formed at the front surface side of the substrate 1. At the positions corresponding to the heat generating elements 2 of the nozzle layer 5, liquid chambers 6 forming a part of a liquid flow passage are formed. Moreover, liquid ejection ports 9 are formed at upper positions of the liquid chambers 6 of the nozzle layer 5. The liquid chamber 6 is a space where liquid supplied from the liquid supply port 10 or the liquid flow passage is temporarily stored. The liquid in the liquid chambers 6 receives energy from the heat generating elements 2, and the liquid to which the energy is given is ejected from the liquid ejection ports 9. Electrode pads 11 are formed at the front surface side of the substrate 1. The heat generating elements 2 can be electrically connected to the outside through wiring, which is not illustrated, from the electrode pads 11.

The substrate 1 is suitably formed with single crystal silicon. A silicon substrate having a surface crystal orientation of (100), i.e., a so-called (100) substrate, is suitable. At the front surface side and the back surface side of the substrate 1, thermal oxidation layers, such as a silicon oxide layer, may be formed.

It is suitable that one or more of the heat generating elements 2 of the substrate are provided. For example, the one or more of the heat generating elements 2 are provided at a predetermined pitch in parallel in two columns. The heat generating elements 2 convert electric energy to thermal energy, and give energy for ejection to liquid. Materials forming the heat generating elements 2 include materials represented by $\alpha x \beta y \gamma z$, for example, ($\alpha$ represents one or more kinds of elements selected from Ta, Ti, Zr, Cr, Mo, and Hf, $\beta$ represents one or more kinds of elements selected from Si and B, and $\gamma$ represents one or more kinds of elements selected from C, O, and N. $x+y+z=100$ atom %). In particular, it is suitable to form the heat generating elements 2 with TaSiN. The heat generating elements 2 may be provided in such a manner as to contact the front surface of the substrate or may be provided in such a manner as to be partially separated from the front surface of the substrate. The heat generating elements 2 may be covered with a protective layer containing SiN, Ta, and the like in order to suppress corrosion due to liquid or achieve electric insulation. The protective layer may be provided over the full front surface of the substrate 1 in order to cover the wiring, which is not illustrated, connecting the heat generating elements 2 and the electrode pads 11.

It is suitable that the substrate 1 and the nozzle layer 5 closely contact with each other through an intermediate layer. As the intermediate layer, resin and Ta are mentioned. When the substrate is a silicon substrate and the nozzle layer is formed with resin, the intermediate layer is suitably formed with amide resin, particularly polyetheramide. These substances are applied onto the substrate 1, and then patterned by photolithography or dry etching, whereby the intermediate layer is formed.

The nozzle layer 5 is suitably formed with resin, such as epoxy resin. Among various kinds of resin, the nozzle layer 5 is suitably formed with a photosensitive resin. The nozzle layer 5 is more suitably formed with a negative photosensitive resin. In the nozzle layer 5, the liquid chambers 6 and the liquid ejection ports 9 are formed. Although described later, the liquid chambers 6 are formed inside the nozzle layer 5 by air bubbles formed by driving the heat generating elements. In view of this fact, when the shape stability of the nozzle layer is taken into consideration, a material forming the nozzle layer (material forming a nozzle layer formation material layer) is suitably a material whose glass transition point (Tg) is higher than a temperature to be applied to the nozzle layer formation material layer by driving the heat generating elements. Specifically, the glass transition point of the nozzle layer formation material layer is suitably set to 100° C. or higher. The glass transition point is more suitably set to 140° C. or higher and may be set to 300° C. or higher. Although the upper limit is not particularly set, it is suitable to set the upper limit to 400° C. or less in terms of the material selectivity.

Hereinafter, a method for manufacturing a liquid ejection head of the present invention is described.

Figure 2A:
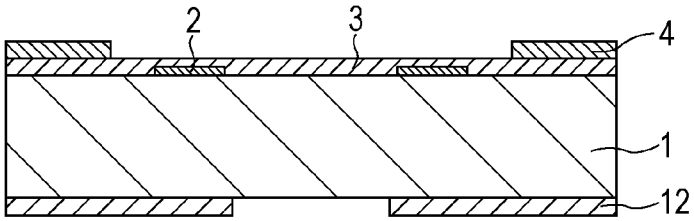
FIGS. 2A to 2E are views illustrating an example of a method for manufacturing a liquid ejection head of the present invention.

FIGS. 2A to 2E illustrate an example of the method for manufacturing a liquid ejection head of the present invention and are cross sectional views along the II-II line of FIG. 1. First, as illustrated in FIG. 2A, the substrate 1 formed with silicon and the like is prepared. At the front surface side of the substrate 1, the heat generating elements 2 containing TaSiN and the like and a protective layer 3 covering the heat generating elements 2 are formed. The heat generating elements 2 are formed at a predetermined pitch in two columns and electrodes and wiring which supply the power supply for driving the heat generating elements 2 are connected to the heat generating elements 2. The protective layer 3 is formed with SiN, Ta, and the like. On the protective layer 3, an intermediate layer 4 is formed. The intermediate layer 4 is formed with polyetheramide and the like. For example, the intermediate layer 4 can be formed by applying a solution containing polyetheramide and the like to the substrate with a spin coater or the like, heating the same, and then patterning the same using dry etching. The thickness of the intermediate layer 4 is suitably set to 2 μm or more and 3 μm or less. At the back surface side of the substrate, an etching mask layer 12 is formed. The etching mask layer 12 can also be formed in the same manner as the intermediate layer 4.

Figure 2B:
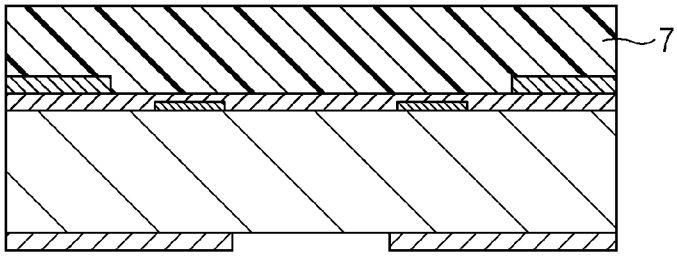

Next, as illustrated in FIG. 2B, a nozzle layer formation material layer 7 is formed at the front surface side of the substrate 1. The nozzle layer formation material layer 7 is formed by applying a coating liquid containing resin and a solvent, for example, to the front surface side of the substrate 1 with a spin coater or the like. The thickness of the nozzle layer formation material layer 7 is suitably set to 10 μm or more and 100 μm or less. The thickness is more suitably 50 μm or less and still more suitably 30 μm or less. However, the heat generating elements 2 need to be covered with the nozzle layer formation material layer 7. The thickness of the nozzle layer formation material layer 7 determines the final thickness of the nozzle layer. A water-repellent layer may be formed at the front surface side (surface opposite to the surface facing the substrate 1) of the nozzle layer formation material layer 7 as required. The water-repellent layer is formed with a fluorine resin and the like.

Figure 2C:
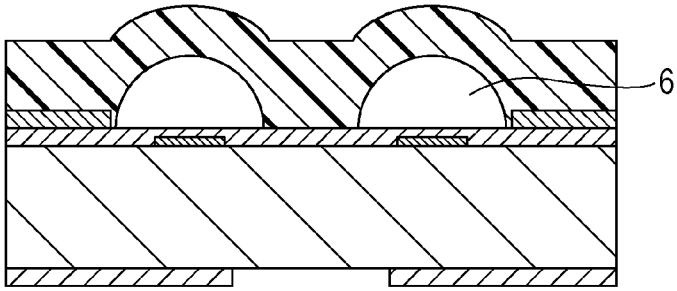

Next, as illustrated in FIG. 2C, the heat generating elements 2 which are electrically bonded are driven to generate thermal energy therefrom. More specifically, the heat generating elements 2 are heated. The electrical bonding to the heat generating elements 2 is not particularly limited and may be performed using wiring from the front surface side of the substrate or may be performed by bringing wiring to the back surface side of the substrate, for example. As an external power supply to be connected to the wiring, a pulse generating apparatus and the like are used, for example. By heating the heat generating elements 2, air bubbles are formed in the nozzle layer formation material layer 7. These air bubbles serve as the liquid chambers 6 and can form the liquid chambers 6 in the nozzle layer formation material layer 7.

Figure 5A:
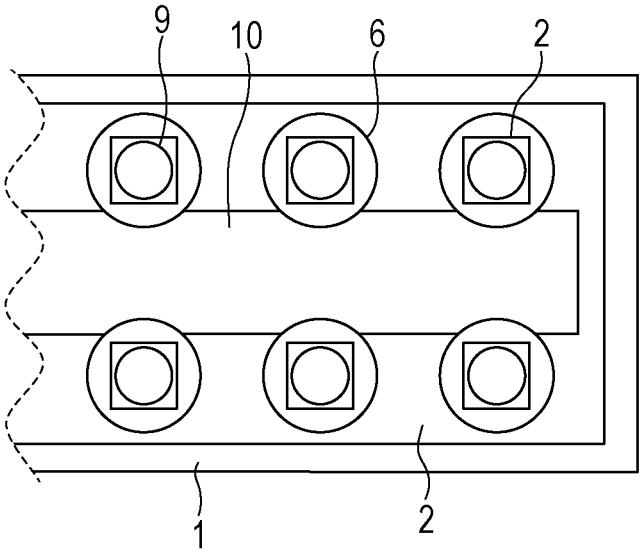
FIGS. 5A and 5B are views illustrating an example of a liquid ejection head manufactured by the present invention.
Figure 5B:
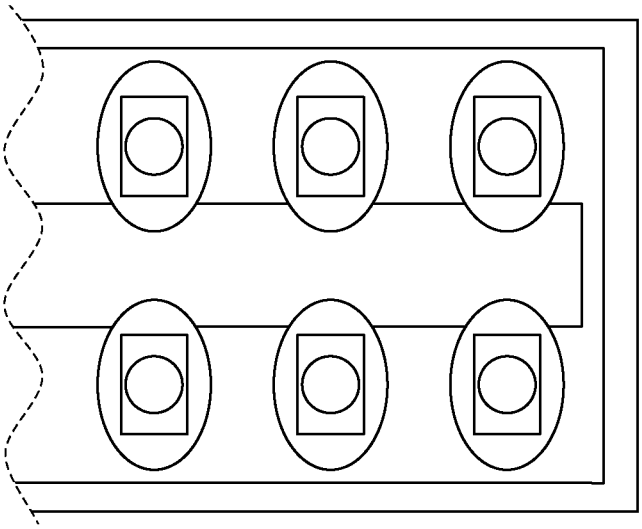

The shape of the liquid chambers 6 can be changed as appropriate according to the size of the heat generating elements 2 and the control (for example, drive time) of thermal energy to be generated as illustrated in FIGS. 5A and 5B. However, when the liquid supply port 10 is formed in the substrate 1, the liquid chambers 6 need to communicate with the liquid supply port 10. More specifically, when the substrate 1 is viewed from the upper side of the front surface, the liquid chambers 6 and the liquid supply port 10 are overlapped with each other as illustrated in FIG. 5. When the liquid flow passage extends from the liquid chambers 6 and the liquid flow passage communicates with the liquid supply port 10, the liquid supply port 10 and the liquid flow passage may be overlapped with each other to make the liquid chambers 6 and the liquid flow passage communicate with each other. The "overlap" as used herein means an overlapping manner in which liquid communicates.

Thus, according to the present invention, the liquid chambers 6 can be formed around the heat generating elements 2 as the center. Therefore, the formation positions of the heat generating elements 2 which are energy-generating elements and the formation positions of the liquid chambers 6 can be easily matched.

Figure 2D:
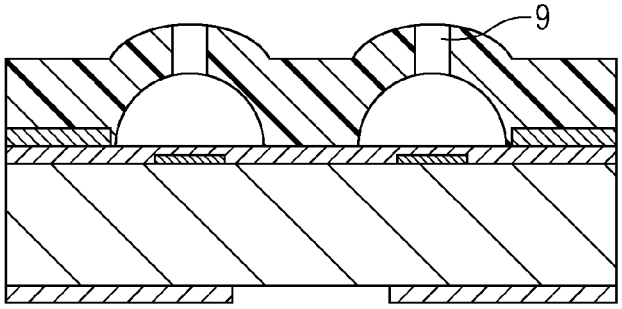

Next, the liquid ejection ports 9 are formed in the nozzle layer formation material layer 7 as illustrated in FIG. 2D. The liquid ejection ports 9 can be formed at the positions corresponding to the heat generating elements 2 and the liquid chambers 6 of the nozzle layer formation material layer 7 using an excimer laser and dry etching, for example. When the nozzle layer formation material layer 7 contains a photosensitive resin and a photocationic polymerization initiator, the liquid ejection ports 9 can also be formed by photolithography. Thus, the nozzle layer formation material layer 7 is formed into the nozzle layer 5 in which the liquid ejection ports 9 are formed.

Figure 2E:
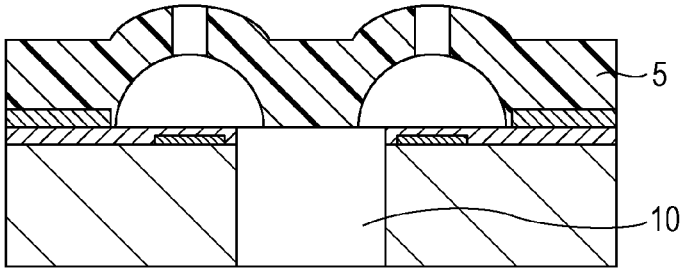

Next, as illustrated in FIG. 2E, the substrate 1 is etched using the etching mask layer 12 formed at the back surface side of the substrate 1 to form the liquid supply port 10 in the substrate 1. The etching includes reactive ion etching, etching by an excimer laser, wet etching, and the like, for example. The etching mask layer 12 is removed as required.

The liquid ejection head of the present invention can be manufactured as described above.

In the example described with reference to FIGS. 2A to 2E, the liquid chambers 6 are formed in the nozzle layer formation material layer 7 in the stage illustrated in FIG. 2C. In this stage, it is suitable to form a metal layer at the front surface side (surface opposite to the surface facing the substrate 1) of the nozzle layer formation material layer 7. An example of forming the metal layer is described with reference to FIGS. 3A to 3E.

Figure 3A:
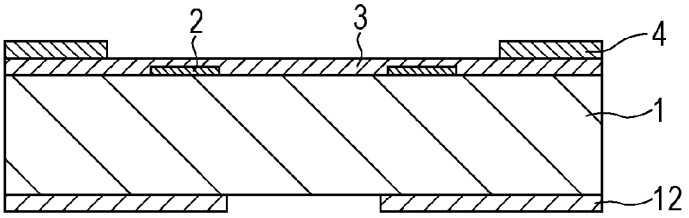
FIGS. 3A to 3E are views illustrating an example of the method for manufacturing a liquid ejection head of the present invention.
Figure 3B:
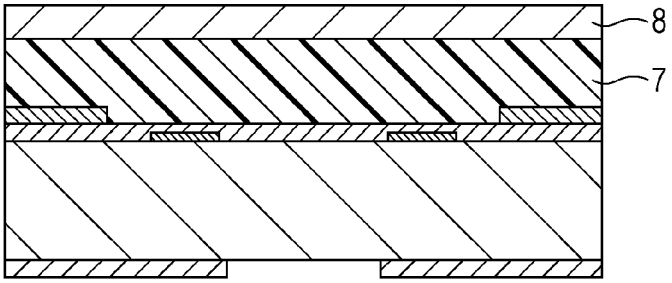

The process before FIG. 3B is the same as the process before FIG. 2B. In FIG. 3B, a metal layer 8 is formed at the front surface side of the nozzle layer formation material layer 7. The thickness of the metal layer is suitably 5 μm or more and 10 μm or less. The thickness of the metal layer is suitably 20% or more and 70% or less of the thickness of the nozzle layer formation material layer 7. The thickness is more suitably 30% or more and 60% or less of the thickness of the nozzle layer formation material layer 7. The metal layer 8 suitably has rigidity which does not allow bending of the metal layer 8 also when air bubbles are generated by the heat generating elements 2 in the nozzle layer formation material layer 7. Such a metal include Ta, TiW, Au, and the like, for example. These metals are suitably formed into the metal layer by sputtering. On the surface of the metal layer 8 (on the surface opposite to the substrate 1), a water-repellent layer may be formed as required.

Figure 3C:
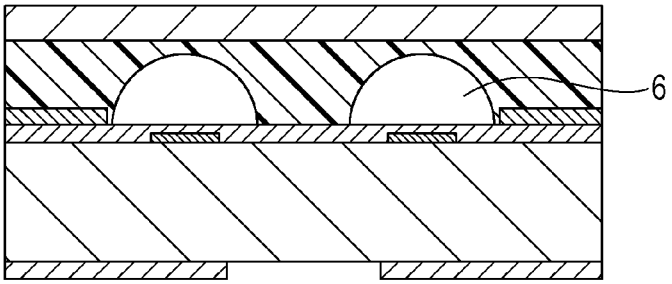
Figure 3D:
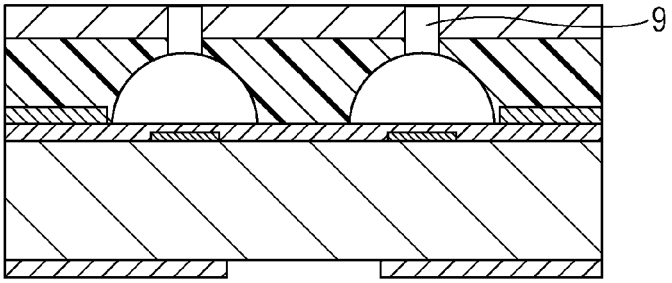
Figure 3E:
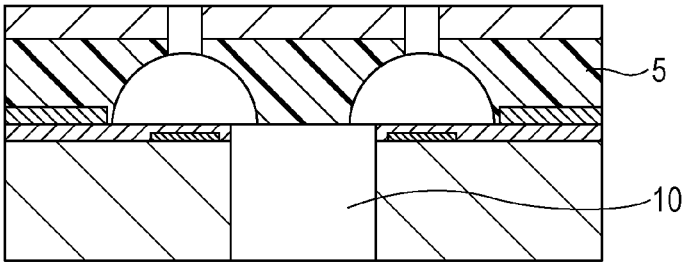

Processes of FIGS. 3C to 3E are the same as those of FIGS. 2C to 2E. However, by forming the metal layer 8, the surface of the nozzle layer formation material layer 7, i.e., the surface of the nozzle layer 5, can be smoothened as illustrated in FIGS. 3C to 3E. Moreover, air bubbles can be prevented from reaching the front surface of the nozzle layer formation material layer 7, and considerably deforming the shape of the liquid chambers 6. In FIG. 3E, although the metal layer 8 is still formed at the front surface side of the nozzle layer 5, the metal layer 8 may be removed as required.

As another example, the nozzle layer formation material layer can also be formed for each liquid chamber. This example is described with reference to FIGS. 4A to 4D.

Figure 4A:
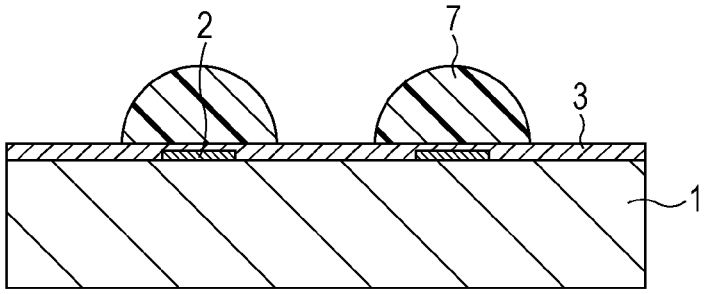
FIGS. 4A to 4D are views illustrating an example of the method for manufacturing a liquid ejection head of the present invention.

FIG. 4A illustrates an example in which the nozzle layer formation material layers 7 are individually formed at the front surface side of the substrate 1. For example, a nozzle layer formation material is dropped using a fine needle in such a manner as to cover the heat generating elements 2 at the front surface side of the substrate 1. Thus, the nozzle layer formation material layer 7 can be formed for each liquid chamber at the front surface side of the substrate 1. According to this process, one nozzle layer formation material layer 7 can be formed corresponding to one liquid chamber 6, for example.

Figure 4B:
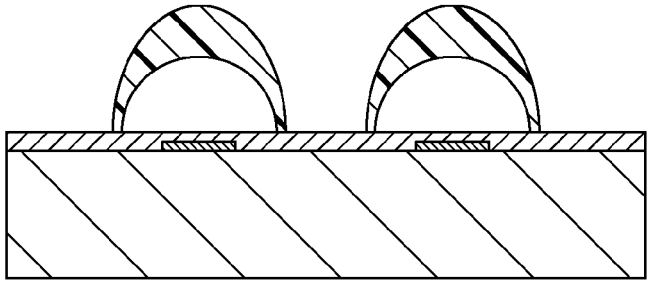
Figure 4C:
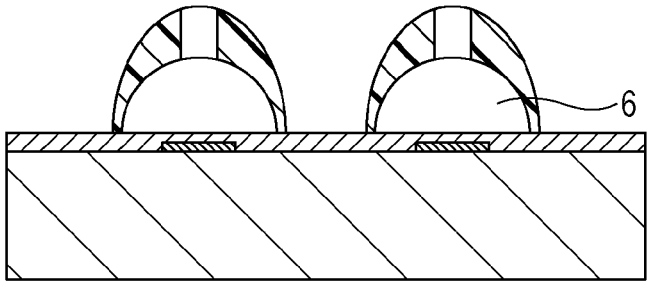
Figure 4D:
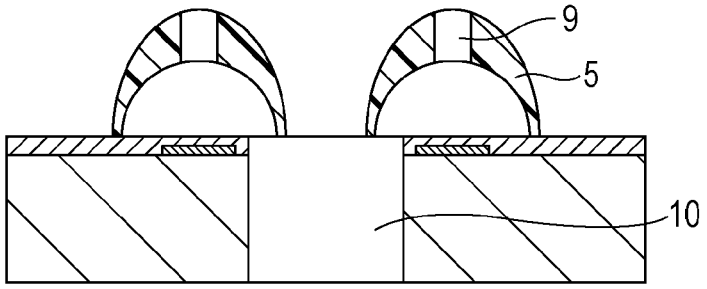

The following processes are performed as illustrated in FIGS. 4B to 4D, whereby a liquid ejection head is manufactured. Processes other than the process of forming the nozzle layer formation material layers 7 are the same as those described with reference to FIGS. 2A to 2E. The liquid ejection head manufactured by the method illustrated in FIGS. 4A to 4D can be structured so that the nozzle layer 5 is divided for each liquid chamber 6. In such a liquid ejection head, stress can be reduced, so that the durability of the nozzle layer becomes favorable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-080390, filed Apr. 9, 2014, which is hereby incorporated by reference herein in its entirety.

What is claimed is:

1. A method for manufacturing a liquid ejection head having a substrate, heat generating elements formed at a front surface side of the substrate, and a nozzle layer forming liquid chambers and liquid ejection ports at the front surface side of the substrate, the method comprising:

preparing the substrate having the heat generating elements and a nozzle layer formation material layer at the front surface side;

driving the heat generating elements for heating to form air bubbles serving as the liquid chambers in the nozzle layer formation material layer; and forming the liquid ejection ports which communicate with the liquid chambers in the nozzle layer formation material layer, and then forming the nozzle layer forming the liquid chambers and the liquid ejection ports at the front surface side of the substrate.

2. The method for manufacturing a liquid ejection head according to claim 1, wherein a glass transition point of a material forming the nozzle layer formation material layer is higher than a temperature to be applied to the nozzle layer formation material layer by driving the heat generating elements.

3. The method for manufacturing a liquid ejection head according to claim 1, wherein a glass transition point of the material forming the nozzle layer formation material layer is 100° C. or higher.

4. The method for manufacturing a liquid ejection head according to claim 1, wherein the nozzle layer formation material layer is formed with a negative photosensitive resin.

5. The method for manufacturing a liquid ejection head according to claim 1, wherein the liquid chambers are formed in such a manner as to overlap with a liquid supply port formed in the substrate when the substrate is viewed from an upper side of the front surface side.

6. The method for manufacturing a liquid ejection head according to claim 1, wherein, when forming the air bubbles serving as the liquid chambers in the nozzle layer formation material layer, a metal layer is formed at a front surface side of the nozzle layer formation material layer.

7. The method for manufacturing a liquid ejection head according to claim 6, wherein a thickness of the metal layer is 20% or more and 60% or less of a thickness of the nozzle layer formation material layer.

8. The method for manufacturing a liquid ejection head according to claim 6, wherein the thickness of the metal layer is 5 μm or more and 10 μm or less.

9. The method for manufacturing a liquid ejection head according to claim 6, wherein the metal layer is formed with at least one of Ta, TiW, and Au.

10. The method for manufacturing a liquid ejection head according to claim 1, wherein one nozzle layer formation material layer is formed corresponding to one liquid chamber.

* * * * *